US005507206A

United States Patent [19]

Solski

[11] Patent Number: 5,507,206

[45] Date of Patent: Apr. 16, 1996

[54] HOSE CLAMP TOOL

[75] Inventor: Michael E. Solski, LaSalle, Canada

[73] Assignee: Ford Motor Company, Dearborn, Mich.

[21] Appl. No.: 254,798

[22] Filed: Jun. 6, 1994

[51] Int. Cl.[6] ..... B25B 27/10

[52] U.S. Cl. ..... 81/9.3; 81/426.5; 29/252

[58] Field of Search ..... 29/252, 243.56, 29/278, 280; 81/9.3, 301, 418, 424.5, 426.5, 319, 368

[56] References Cited

U.S. PATENT DOCUMENTS

| | | |
|---|---|---|
| 2,677,982 | 5/1954 | Arras et al. . |
| 2,898,789 | 8/1959 | Meese . |
| 3,161,086 | 12/1964 | Kircher . |
| 4,091,483 | 5/1978 | Lewis . |
| 4,386,461 | 6/1983 | Plummer . |
| 4,669,341 | 6/1987 | Small . |
| 4,858,279 | 8/1989 | Kato et al. . |
| 5,168,783 | 12/1992 | Shea . |
| 5,209,143 | 5/1993 | Sweet . |

*Primary Examiner*—Bruce M. Kisliuk
*Assistant Examiner*—Joni B. Danganan
*Attorney, Agent, or Firm*—D. B. Kelley; R. L. May

[57] ABSTRACT

A tool for removing a retaining cap from a hose clamp has a handle to which is attached a retaining cap nest having a cap receiving portion for receiving the capped ears of the hose clamp, an opening in an end of the receiving portion for accepting an uncapped portion of the capped ears, and a pair of lands, one on either side of the opening, for pushing against the legs of the cap during removal from the ears. In one embodiment, the nest has a pair of symmetrically shaped half-sections attached to the jaws of a locking pliers type tool which are placed around the capped ears. When the handles of the tool are squeezed together, a nest is formed capable of retaining the cap after removal from the ears. A preferred embodiment has a handle with a hollow cylindrical jacket attached thereto surrounding a pneumatically operated rod to which is affixed a unitary nest. When in an extended position, the nest can be positioned to grasp the hose clamp retaining cap in the receiving portion. The nest is then pneumatically retracted within the jacket thus removing and holding the retaining cap, and allowing the clamp to compress around a hose to which it is attached.

4 Claims, 4 Drawing Sheets

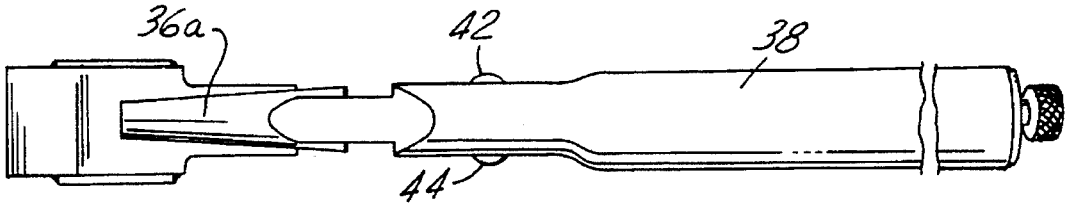
FIG.6
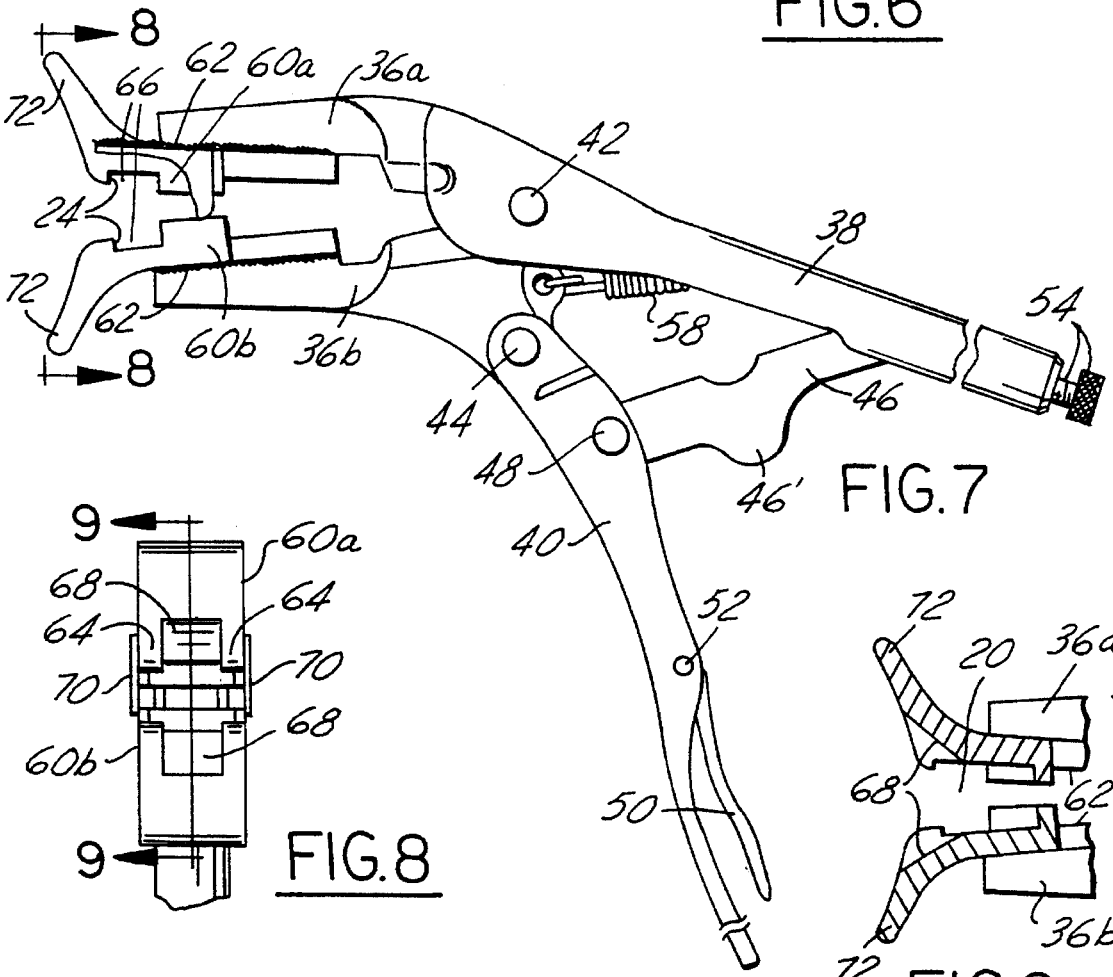
FIG.7
FIG.8
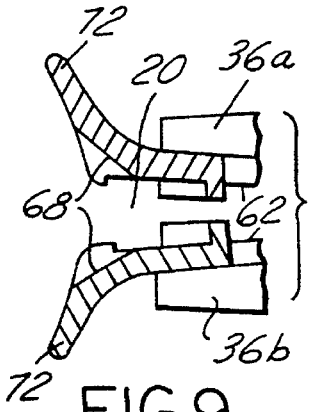
FIG.9
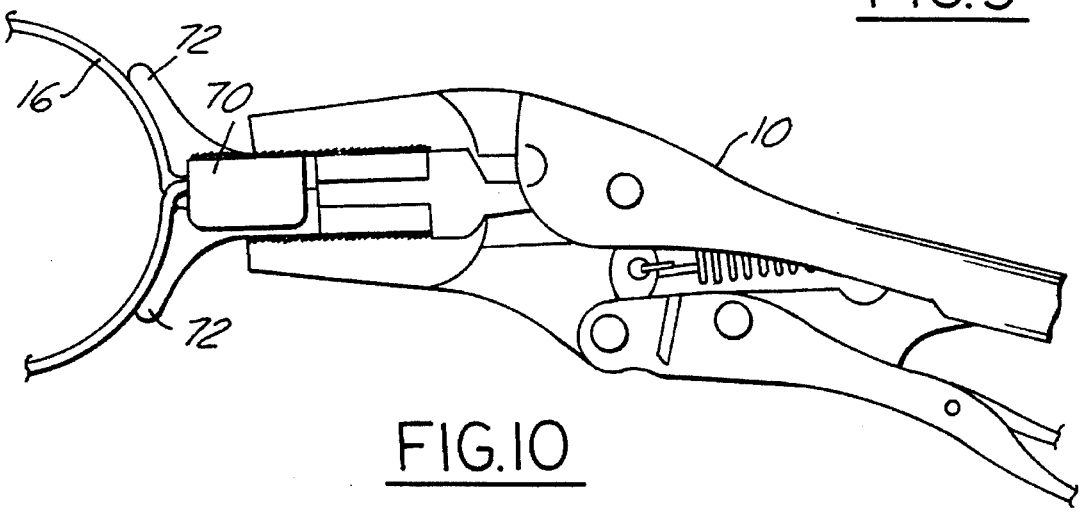
FIG.10

HOSE CLAMP TOOL

FIELD OF THE INVENTION

The present invention relates to assembly tools, and, more particularly, to a tool for facilitating assembly of hose clamps to hoses.

BACKGROUND OF THE INVENTION

Hoses are commonly used for various connections in fluid systems. For example, many internal combustion engines have systems requiring fluid circulation, such as a cooling system, a lubrication system, a power steering system, and a brake system. Often the fluid in such systems must be conveyed between separated components, for example, coolant circulated from the engine block to the radiator and back. Connections between such components are typically effected with a hose, usually made of rubber or another flexible material, which can attach over a pipe or other mating member extending from one of the components.

To ensure a fluid tight seal between the hose and a mating member, a fastener is ordinarily attached to hold the hose firmly against the mating member. One such fastener is a hose clamp, of which there are several variations, but which in a most basic form includes a circular, spring steel wire or band with radially extending ears on each end of the wire or band. The clamp is formed such that, when in a sprung, unflexed position, the ends of the band overlap circumferentially so that the inner diameter of the clamp is smaller than the outer diameter of the hose to which it is attached. The overlap is accomplished by providing a longitudinal slot in one end while the other end is narrowed to fit within the slot. FIGS. 2 and 17 of U.S. Pat. No. 4,858,279 (Kato, et al.) illustrate the concept.

The hose clamps described have been assembled to hoses with a pliers-like tool which was used to grasp and squeeze together the ears of the hose clamp so as to expand the inner diameter of the hose clamp and allow insertion of the hose therein. Tools for facilitating this task are disclosed in U.S. Pat. Nos. 5,209,143 (Sweet), 2,677,982 (Arras, et al.), and 3,161,086 (Kircher). For ease of assembly, present day hose clamps are pre-expanded and the ears are locked together, or capped, with a retaining cap to prevent the clamp from springing shut. An example of such a capped hose clamp is illustrated in FIG. 20 of U.S. Pat. No. 4,858,279 (Karo, et al.). After the clamp is positioned over a hose, an assembler must only remove the cap to allow the clamp to contract to a fastening position.

One problem with the above described clamp is that the cap, if not properly handled upon removal from the clamp ears, may fall, for example into an engine compartment of a vehicle where the hose clamp is being attached. A loose cap may cause noise or damage a nearby component. A problem with prior hose clamp tools is the lack of means for holding the retaining cap after removed from the capped ears. The cap could potentially damage a surrounding component should it be projected from the clamp during removal.

An object of the present invention is to provide a hose clamp assembly tool which will safely remove and hold a hose clamp ear retaining cap.

Another object of the present invention is to provide a hose clamp assembly tool that will allow a constant tension hose clamp to be assembled properly and with little effort.

An advantage of the present invention is the capability to retract and secure the hose clamp ear retaining cap from a pre-expanded hose clamp.

A feature of the present invention is a nest between the jaws of the hose clamp tool for retracting and capturing the hose clamp ear retaining cap.

SUMMARY OF THE INVENTION

The above described objects and advantages are achieved by providing a hose clamp tool comprising a handle, means attached to the handle for grasping a removable retaining cap from a hose clamp, and means attached to said handle for holding the retaining cap after removal from the hose clamp. The retaining cap retains a pair of radially extending ears in close proximity to each other at the distal ends of a hose clamp.

The means for grasping and holding preferably comprise a retaining cap nest having a receiving portion, an opening at an end of the receiving portion for accepting an uncapped portion of the hose clamp ears when capped, and a pair of lands located on the interior of the retaining cap receiving portion, with one of the pair of lands located on a first side of the opening and the other located on a second side of the opening. The tool also preferably has a pair of tool positioning members attached to the nest end of the tool for positioning the tool relative to the hose clamp and the ears when capped, one of the positioning members located on a first side of the opening and the other located on a second side of the opening.

One embodiment of the hose clamp tool according to the present invention comprises a Vise-Grip® like tool having a pair of jaws, with each of the jaws having a symmetrically shaped nest half-section attached thereto such that the jaws can be positioned over the ears when capped and the Vise-Grip® like tool squeezed to form a nest around the ears.

A preferred embodiment of the hose clamp tool has means for removing the retaining cap from the ears when capped comprising a pneumatically extendable and retractable nest, housed within the handle, such that after the nest is placed around the retaining cap, the nest is forced toward the handle end of the tool thereby removing the retaining cap from the ears when capped. In this embodiment, the retaining cap receiving portion is preferably enclosed by a jacket extending from the handle when the nest is retracted so that the retaining cap is held within the nest after removal from the ears when capped.

BRIEF DESCRIPTION OF THE DRAWING

FIG. 6 is a top view of a hose clamp tool according to the present invention.

FIG. 7 is a side view of a locking pliers type hose clamp tool according to the present invention.

FIG. 8 is a front view of the modified locking pliers jaws of the hose clamp tool of FIG. 7 taken along line 8—8 thereof showing a retaining cap receiving nest.

FIG. 9 is a partially cut-away view of the retaining cap nest along line 9—9 of FIG. 8.

FIG. 10 is a side view of a hose clamp tool, similar to FIG. 7, shown grasping a hose clamp with capped ears before removal of the retaining cap from the capped ears.

DETAILED DESCRIPTION OF THE PREFERRED EMBODIMENTS

Figure 1:
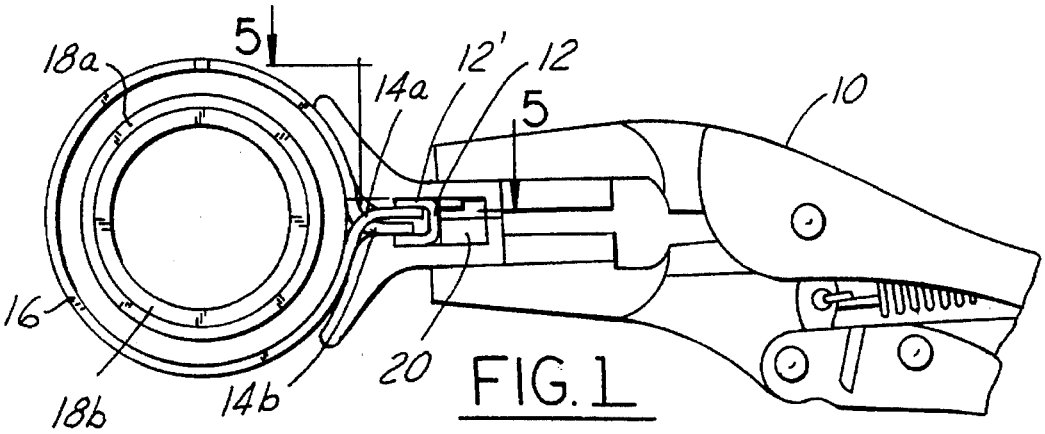
FIG. 1 is a partially cut-away view of a hose clamp tool according to the present invention shown grasping the capped hose clamp ears of a hose clamp before removal of a retaining cap which holds the ears in proximity and thus the clamp in a position with an expanded diameter.

An embodiment of a hose clamp tool 10 according to the present invention is shown, partially cut-away, in FIG. 1. Hose clamp tool 10 provides a means to remove a retaining cap 12 from radially extending ears 14*a* and 14*b* of hose clamp 16. Hose clamp 16, shown in the expanded position in FIG. 1, fits around concentric circular cross-section shaped sections 18*a* and 18*b*. Sections 18*a* and 18i can be, for example, a rubber hose and an aluminum or plastic tube, respectively, as better seen in FIG. 11 and described in more detail below. Such tubular structures are commonly used to connect two components or systems in which fluid must communicate therebetween. Hose clamp 16 ensures a fluid tight seal between sections 18*a* and 18*b*, which might otherwise leak, as will be appreciated by those skilled in the art.

Figure 2:
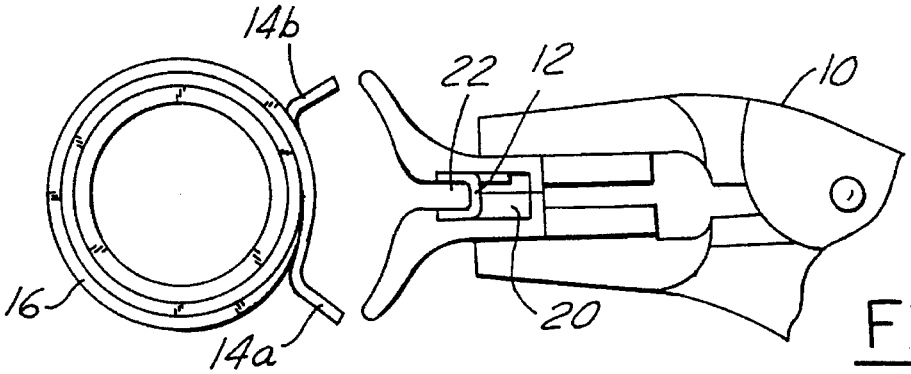
FIG. 2 is a partially cut-away view similar to FIG. 1 but showing the hose clamp after the retaining cap has been removed from the hose clamp ears, with the retaining cap held in the tool according to the present invention.

Referring again to FIG. 1, hose clamp tool 10 has a retaining cap receiving portion, or nest 20, to accommodate radially extending ears 14*a* and 14*b* when capped by retaining cap 12. An opening 22 at a distal end of nest 20, as seen in FIG. 2, accepts an uncapped portion of capped ears 14*a* and 14*b*, as shown in FIG. 1. A pair of lands 24 are located on the interior of nest 20, with one of the lands located on a first side of opening 22 and the other of the lands 24 located on a second side of the opening. Lands 24 are best seen in FIG. 7. Nest 20 is placed around capped ears 14*a* and 14*b* so that lands 24 in nest 20 abut a bottom portion of cap legs 12'(FIG. 1). As tool 10 is pulled away from hose clamp 16, lands 24 push against legs 12' thus retracting cap 12 from ears 14*a* and 14*b*. When cap 12 has been completely removed, ears 14*a* and 14*b* spring away from each other as hose clamp 16 shrinks in internal diameter thus tightening around hose 18*a* (FIG. 2). Cap 12 is retained within nest 20 until released, as further described below.

Figure 5:
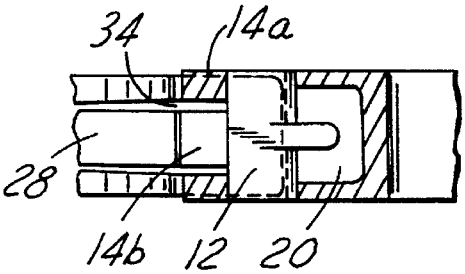
FIG. 5 is a cross-sectional view taken along line 5—5 of FIG. 1 and shows capped hose clamp ears as grasped within a retaining cap nest of a tool according to the present invention.
Figure 3:
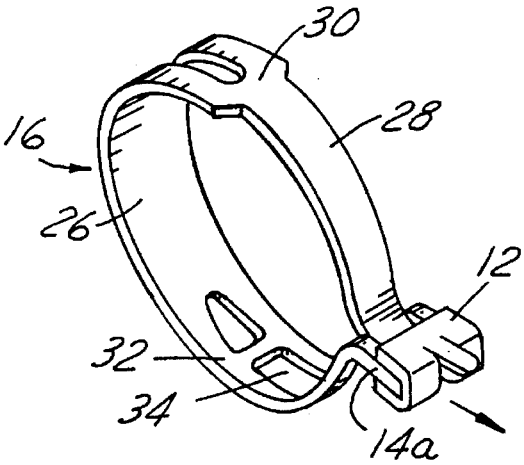
FIG. 3 is a perspective view of a hose clamp shown in the capped position.
Figure 4:
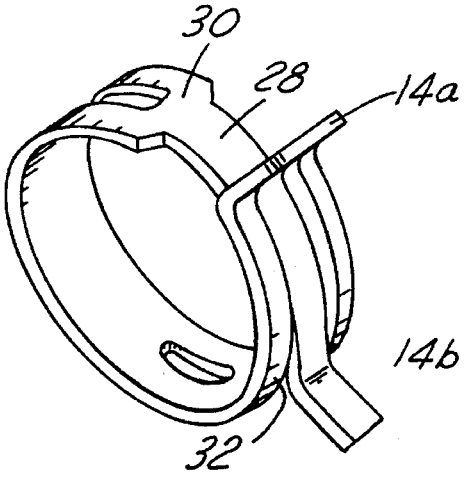
FIG. 4 is a perspective view similar to FIG. 4 showing a hose clamp in the uncapped position.

The structure and operation of hose clamp 16 is depicted in FIGS. 3 and 4. In FIG. 3, hose clamp 16 with capped ears 14*a* and 14*b* is shown in a perspective view. Clamp 16 consists of a spring steel band 26 having a spring force appropriate for the hose to which it will be applied. Band 26 is formed in a circular shape with opposing ends 30 and 34. Narrowed strip 28 extends from end 30 of band 26 and has ear 14*b* extending radially therefrom (FIGS. 1 and 3). On opposite end 32 of band 26 is slot 34 which receives narrowed portion 28 when hose clamp 16 is in the uncapped, sprung position as shown in FIG. 4. End 32 also has ear 14*a* extending radially therefrom and slot 34 stretches into a portion of ear 14*a* so as to receive ear 14*b* when hose clamp 16 is in the capped position (FIG. 5).

Top and side views of an embodiment of a hose clamp tool 10 are shown in FIGS. 6 and 7, respectively. Hose clamp tool 16 comprises, in part, a Vise-Grip®, or locking type, pliers known to those skilled in the art and suggested by this disclosure. However, tool 16 of the present invention has a pair of opposing jaws 36*a* and 36*b* modified to accommodate nest 20. Jaw 36*a* is fixed relative to handle 38 while jaw 36*b* is pivotally mounted to handles 38 and 40 with hinge rivets 42 and 44, respectively. Handles 38 and 40 have oppositely faced channel cross-sections (not shown), and are connected by link 46 which is slidably disposed in the channel cross-section of handle 38 and pivotally joined to handle 40 by rivet 48 located rearward of rivet 44. For purposes of this invention, the term "rearward" and "rearwardly" mean at a location on tool 10 away from jaws 36*a* and 36*b*. A releasing lever 50 is pivotally engaged in the channel cross-section of handle 40 and cooperates with knob 46' of link 46 to facilitate opening of jaws 36*a* and 36*b* when gripping cap 12.

When handles 38 and 40 are squeezed to lock jaws 36*a* and 36*b* together, knob 46' contacts a portion of releasing lever 50 between rivet 48 and rivet 52. Jaws 36*a* and 36*b* can be unlocked by depressing on the portion of lever 50 projecting rearwardly away from rivet 52. Adjustment of the closing distance between jaws 36*a* and 36*b*, and thus the size of nest 20, is accomplished by turning head 54 of thumbscrew 56 at a rearmost end of handle 38. An end (not shown) of thumbscrew 56 abuts link 46 in the channel cross-section of handle 38 thus limiting the rearward sliding movement of link 46 in the channel. As handles 38 and 40 are squeezed together, link 46 pivots around rivet 48 while sliding rearwardly in the channel of handle 38 until contacting thumbscrew 56. Handle 40 then acts as a lever, through link 46, to rotate jaw 36*b* toward jaw 36*a* against the force of coil spring 58. Thus, by squeezing handles 38 and 40 together, jaws 36*a* and 36*b* move together in locking engagement to form nest 20 (FIG. 9).

As seen in FIGS. 7 through 9, jaws 36*a* and 36*b* have symmetrically shaped nest half-sections 60*a* and 60*b*, respectively, attached thereto, preferably by welding, to a forward portion of jaw interior surfaces 62. As used herein the term "forward" refers to a portion of tool 10 toward or near jaws 36*a* and 36*b*. Nest half-sections 60*a* and 60*b* have side members 64 (FIG. 8) with half-rectangular shaped cut-outs 66 therein (FIG. 7). As will be understood by those skilled in the art, half-sections 60*a* and 60*b* need not be symmetrically shaped. Rather, the nest portions on jaws 36*a* and 36*b* can take any shape so long as a nest which encloses capped ears 14*a* and 14*b* is formed when jaws 36*a* and 36*b* are engaged. Half-sections 60*a* and 60*b* are preferably symmetrically shaped for ease of manufacturing and assembly.

Between side members 64 is chamfered section 68 which provides a gradual release for the spring energy of ears 14*a* and 14*b* as cap 12 is removed therefrom (FIG. 9). Chamfered section 68 slants at an angle of approximately 30° to 60°, and preferably 45°, from a line parallel with jaw interior surfaces 62. Affixed to half-section 60*a* are shields 70 which cover cut-outs 66. Integrally formed with side members 64 are arc-shaped, tool positioning members 72 which serve to locate and stabilize tool 10 when grasping capped ears 14*a* and 14*b* of clamp 16, as shown in FIG. 10.

Figure 11:
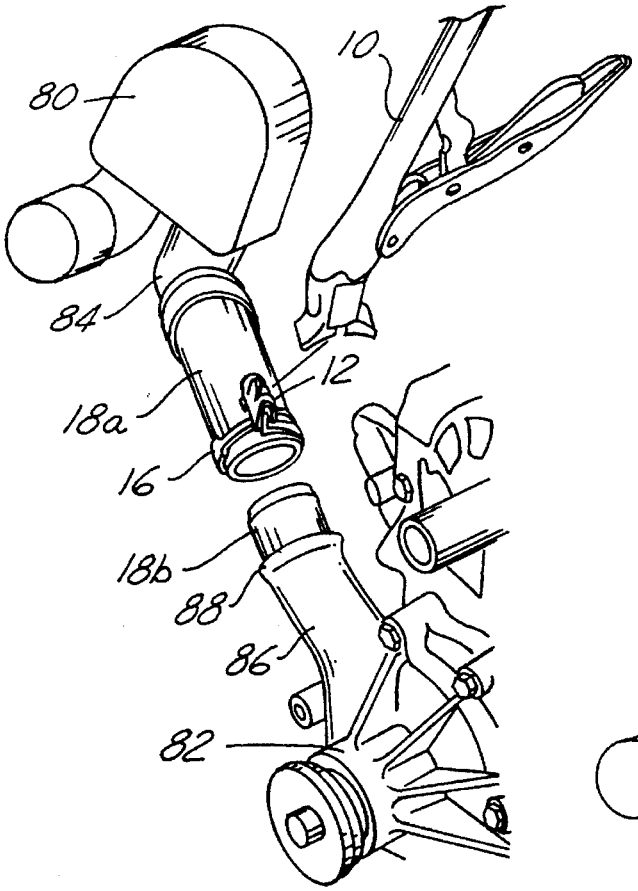
FIG. 11 is a perspective view of an oil cooler assembly having a hose with a hose clamp attached thereto shown before connection to an attachment from a water pump.
Figure 12:
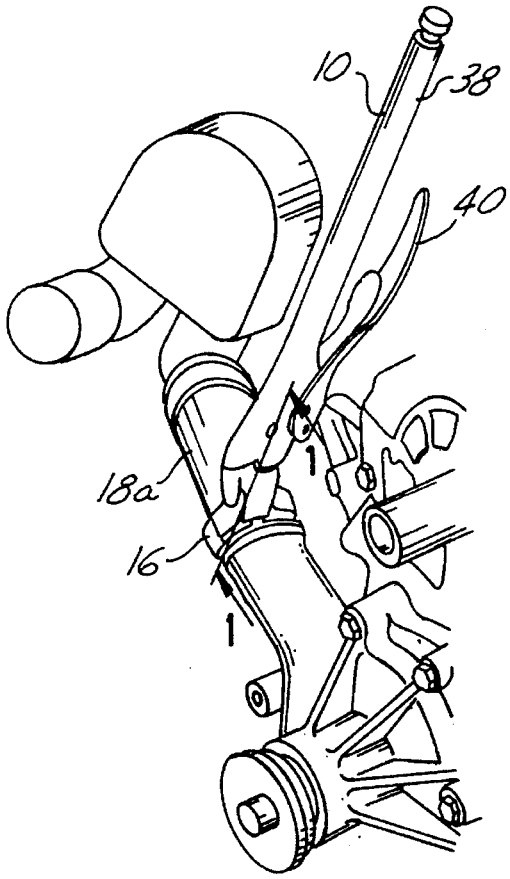
FIG. 12 is a perspective view similar to FIG. 11 but showing the hose clamp tool grasping the retaining cap in preparation for removal from the hose clamp ears to allow the hose clamp to fasten the oil cooler assembly hose to the water pump attachment.
Figure 13:
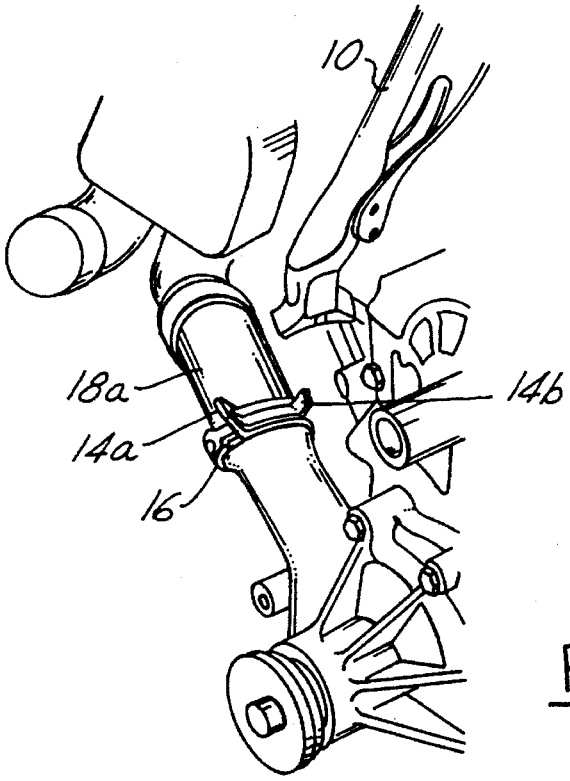
FIG. 13 is a perspective view similar to FIG. 12 but showing the hose clamp after removal of the retaining cap.

Use of tool 10 during assembly of components connected with a hose, such as oil cooler 80 and water pump 82, is depicted in FIGS. 11 through 13. In FIG. 11, oil cooler 80 has outlet 84 to which hose 18a is attached. Hose 18*a* has clamp 16 pre-attached thereto, for example by gluing. Clamp 16 is pre-expanded by compressing ears 14*a* and 14*b* toward each other and holding them together with retaining cap 12 as described above (FIG. 1). Water pump 82 has inlet 86 with flange 88 from which extends protruding tube member 18*b*. Tube member 18*b* has an outer diameter approximately the same size as the inner diameter of hose 18*a*. As seen in FIG. 12, hose 18*a* is fitted over tube member 18*b* so as to abut flange 88. Jaws 36*a* and 36*b* of tool 10 are positioned around capped ears 14*a* and 14*b*, as described above, and handles 38 and 40 squeezed together to form nest 20 (FIG. 1). As tool 10 is withdrawn from the connection (FIG. 13), cap 12 is removed and retained within nest 20. The spring force of clamp 16 causes ears 14*a* and 14*b* to separate in opposite circumferential directions due to the spring force of clamp 16 which compresses around the connection to fasten hose 18*a* to tube member 18*b*.

A preferred embodiment of hose clamp tool 100 according to the present invention, which utilizes pneumatic power, is shown in FIGS. 14 through 17. Tool 100 has cylindrically shaped handle 102 which houses a pneumatically operated cylinder (not shown) that can move along the central axis 104 of handle 102. Rod 106 is attached on one end to the cylinder for movement therewith as will be further described below. A retaining cap nest 108 is fixed to the other end of rod 106. Nest 108 has a retaining cap receiving portion 110, an opening 112 at an end of receiving portion 110 for accepting an uncapped portion 113 (FIG. 17) of the capped hose clamp ears, and a pair of lands 114 located in the interior of retaining cap receiving portion 110 on either side of opening 112. Nest 108 is placed around capped ears 14*a* and 14*b* so that lands 114 in nest 108 abut a bottom portion of cap legs 12'. As nest 108 is pneumatically retracted away from hose clamp 16, lands 114 push against legs 12' thus retracting cap 12 from ears 14*a* and 14*b*. When cap 12 has been completely removed, ears 14*a* and 14*b* spring away from each other as hose clamp 16 shrinks in internal diameter thus tightening around hose 18*a* as described above (FIG. 2). Cap 12 is retained within nest 108 until released, as further described below.

It be will understood by those skilled in the art that tool 100 may be operated hydraulically in the same or a similar manner as the pneumatic operation just described.

Figure 14:
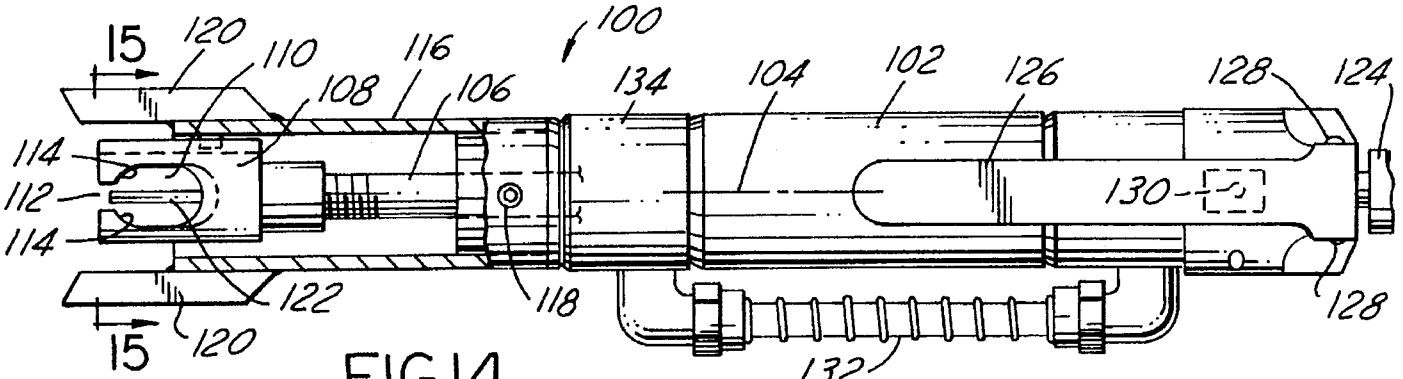
FIG. 14 is a partially cut-away side view of a pneumatically operated hose clamp tool according to a preferred embodiment of the present invention.
Figure 16:
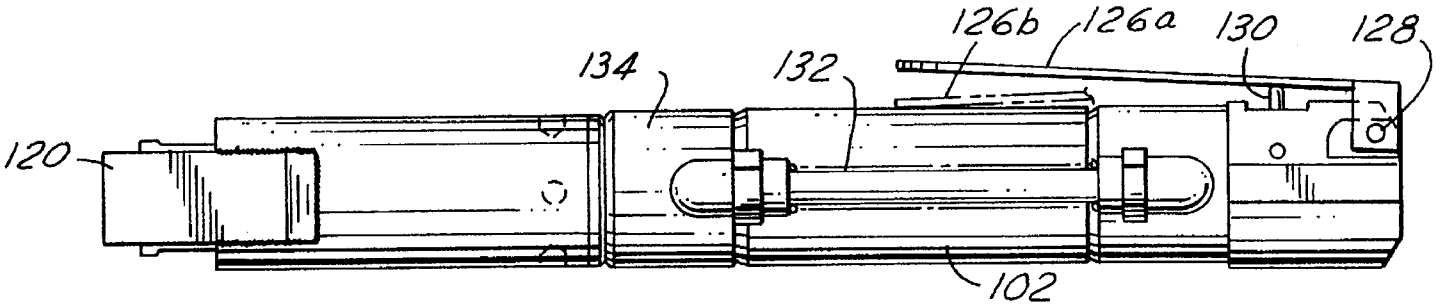
FIG. 16 is a top view of the preferred hose clamp tool shown in FIG. 14.
Figure 15:
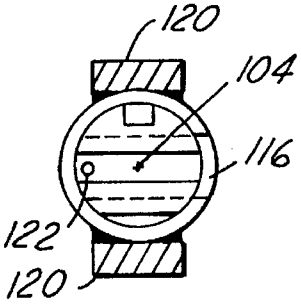
FIG. 15 is an end view taken along line 15-15 of FIG. 14.

Cylindrical jacket 116 attaches to a forward section of handle 102 by screw 118 and provides a shield to prevent cap 12 from falling from nest 108 after retraction from clamp 16 (FIGS. 14 and 16). Tool positioning members 120, which serve to locate and stabilize tool 100 when grasping capped ears 14*a* and 14*b* of clamp 16, are attached to jacket 116 near nest 108 end of tool 100, as shown in FIG. 14. Pin 122 is positioned on an outer edge of receiving portion 110 to act as a stop for locating capped ears 14*a* and 14*b* within receiving portion 110 of nest 108 (FIGS. 14 and 15).

Handle 102 has air inlet 124 (FIG. 14) at a rear end thereof for receiving high pressure air from an air compressor or other source (not shown). Lever switch 126 is pivotally attached on the outer surface of handle 102 by rivet 128. With lever 126 in the undepressed position 126*a* (FIG. 16), spring loaded plunger 130 allows high pressure air to be routed through an internal passage (not shown), through cylinder bypass tube 132, and to forward handle section 134 where it acts on the internal cylinder to force it rearward toward air inlet 124 against a biasing spring (not shown) which biases the cylinder toward the jacket 116 end of tool 100. Nest 108 is thus in a retracted position (not shown) within jacket 116.

Figure 17:
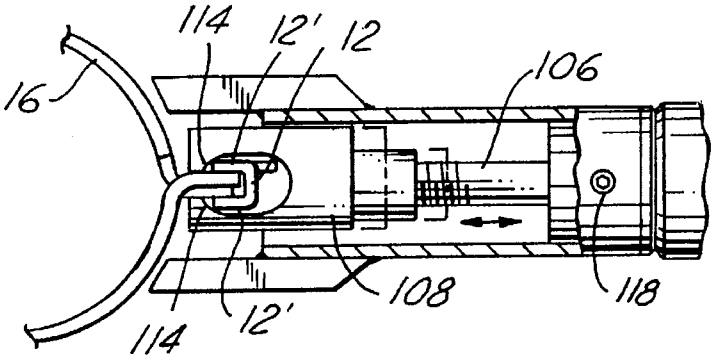
FIG. 17 is a partially cut-away side view of the retaining cap end of a hose clamp tool shown grasping the capped ears of a hose clamp.

When lever switch 126 is depressed to position 126*b* (FIG. 16), spring loaded plunger 130 blocks high pressure air from reaching forward handle section 134. The internal cylinder is thus forced forward by the biasing spring, as are rod 106 and nest 108. In this extended position, nest 108 is no longer housed within jacket 116 and can grasp capped ears 14*a* and 14*b* as shown in FIG. 17.

After tool 100 has grasped the capped ears 14*a* and 14*b*, lever switch 126 is released to position 126*a*. Plunger 130 again unblocks the internal passage in handle 102 allowing high pressure air to force the cylinder, and thus nest 108, to the retracted position (not shown) within jacket 116. In moving to the retracted position, lands 114 push against legs 12' thus removing cap 12 from ears 14*a* and 14*b*. When cap 12 has been completely removed, ears 14*a* and 14*b* spring away from each other as described above allowing clamp 16 to tighten around the hose.

Cap 12 is retained in receiving portion 110 since nest 108 has retracted within jacket 116. To release cap 12, lever switch 126 is again depressed to position 126*b* and nest 108 extends beyond the shielding reach of jacket 116. Tool 100-need only be rotated about center axis 104 so that pin 122 is above cap 12 so it will fall by gravity from nest 108. Thus, cap 12 will remain within nest 108 until a purposeful effort is made by the operator of tool 100 to remove it. Cap 12 can therefore be quickly and easily removed from clamp 16.

Although the preferred embodiment of the present invention has been disclosed, various changes and modification may be made without departing from the scope of the invention as set forth in the appended claims.

I claim:

1. A hose clamp retaining cap removal tool for grasping and removing a retaining cap from a pair of radially extending ears at the distal ends of a hose clamp and holding the retaining cap after removal from the ears, the tool comprising:

(1) a handle;

(2) means for removing said retaining cap from said ears when capped comprising a rod attached to said handle, said rod extendable and retractable along a line parallel to an axis between a front of said tool and said handle with;

(3) retaining cap nest attached to said rod having (a) retaining cap receiving portion for receiving said ears when capped;

(b) an opening an an end of said receiving portion for accepting an uncapped portion of said ears when capped; and (c) pair of lands located on the interior of said retaining cap receiving portion, one of said pair of lands located on a first side of said opening and the other of said pair of lands located on a second side of said opening, with said lands being adapted to abut the retaining cap, so as to cause the cap to become disengaged from the clamp when the tool is drawn away from the clamp; and (4) a pair of tool positioning members attached to the nest end of the tool for positioning the tool relative to the hose clamp and the ears when capped, one of said pair of positioning members located on a first side of said opening and the other of said pair of positioning members located on a second side of said opening.

2. A hose clamp tool according to claim 1 wherein the retaining cap receiving portion is enclosed by a jacket when said nest is retracted, said jacket extending from the handle, so that said retaining cap is held within said nest after removal from said ears when capped.

3. A tool according to claim 1 wherein said rod is pneumatically extendable and retractable.

4. A tool according to claim 1 wherein said rod is hydraulically extendable and retractable.

* * * * *